US006277000B1

(12) United States Patent
Gotcher

(10) Patent No.: US 6,277,000 B1
(45) Date of Patent: Aug. 21, 2001

(54) POLISHING CHUCKS, SEMICONDUCTOR WAFER POLISHING CHUCKS, ABRADING METHOD, POLISHING METHODS, SEMICONDUCTOR WAFER POLISHING METHODS, AND METHODS OF FORMING POLISHING CHUCKS

(75) Inventor: Leland F. Gotcher, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/511,174

(22) Filed: Feb. 22, 2000

Related U.S. Application Data

(62) Division of application No. 09/266,411, filed on Mar. 10, 1999, now Pat. No. 6,176,764.

(51) Int. Cl.[7] ..... B24B 1/00

(52) U.S. Cl. ..... 451/41; 451/54; 451/55; 451/59; 451/63

(58) Field of Search ..... 451/41, 285, 287, 451/288, 289, 54, 55, 59, 63, 388, 397, 398

(56) References Cited

U.S. PATENT DOCUMENTS

| | | | |
|---|---|---|---|
| 3,977,130 | 8/1976 | Degner . | |
| 4,918,869 | 4/1990 | Kitta . | |
| 5,036,630 | 8/1991 | Kaanta et al. . | |
| 5,095,661 | 3/1992 | Gill, Jr. et al. . | |
| 5,400,547 | 3/1995 | Tanaka et al. . | |
| 5,441,444 | 8/1995 | Nakajima | 451/289 |
| 5,486,129 | 1/1996 | Sandhu et al. . | |
| 5,532,903 | 7/1996 | Kendall . | |
| 5,584,746 | 12/1996 | Tanaka et al. . | |
| 5,584,751 | 12/1996 | Kobayashi et al. | 451/288 |
| 5,588,902 | 12/1996 | Tominaga et al. . | |
| 5,624,299 | 4/1997 | Shendon . | |
| 5,645,474 | 7/1997 | Kubo et al. . | |
| 5,724,121 | 3/1998 | McKinley et al. . | |
| 5,730,642 * | 3/1998 | Sandhu et al. | 451/41 |
| 5,769,697 | 6/1998 | Nishio . | |
| 5,816,900 | 10/1998 | Nagahara et al. . | |
| 5,888,120 * | 3/1999 | Doran | 451/41 |
| 5,931,725 | 8/1999 | Inaba et al. . | |
| 5,938,884 | 8/1999 | Hoshizaki et al. . | |

* cited by examiner

*Primary Examiner*—Eileen P. Morgan
(74) *Attorney, Agent, or Firm*—Wells, St. John, Roberts, Gregory & Matkin P.S.

(57) ABSTRACT

Polishing chucks, semiconductor wafer polishing chucks, abrading methods, polishing methods, semiconductor wafer polishing methods, and methods of forming polishing chucks are described. In one aspect a polishing chuck includes a body dimensioned to hold a work piece, and a multi-positionable, force-bearing surface is positioned on the body. The surface has an undeflected position, and is bi-directionally deflectable away from the undeflected position. A deformable work piece-engaging member is disposed adjacent the force-bearing surface for receiving a work piece thereagainst. The work piece-engaging member is positioned for movement with the force-bearing surface. In another aspect, a yieldable surface is provided on the body and has a central area and a peripheral area outward of the central area. One of the central and peripheral areas is movable, relative to the other of is the areas to provide both inwardly and outwardly flexed surface configurations. A porous member is provided on the yieldable surface and is positioned to receive a work piece thereagainst. The porous member is preferably movable by the yieldable surface into the surface configurations in which more force can be exerted on outermost portions of a work piece during polishing than on innermost portions of a work piece. A deflector is operably connected with the surface and configured to move the surface into the non-planar configuration. A work piece-engaging expanse of material is positioned on the surface of the body and is movable thereby when the surface is moved into the non-planar, force-varying configuration.

55 Claims, 6 Drawing Sheets

POLISHING CHUCKS, SEMICONDUCTOR WAFER POLISHING CHUCKS, ABRADING METHOD, POLISHING METHODS, SEMICONDUCTOR WAFER POLISHING METHODS, AND METHODS OF FORMING POLISHING CHUCKS

RELATED PATENT DATA

This patent resulted from a divisional application of U.S. patent application Ser. No. 09/266,411, filed Mar. 10, 1999, now U.S. Pat. No. 6,176,764 entitled "Polishing Chucks, Semiconductor Wafer Polishing Chucks, Abrading Methods, Polishing Methods, Semiconductor Wafer Polishing Methods, and Methods of Forming Polishing Chucks", naming Leland F. Gotcher, Jr., as inventor, the disclosure of which is incorporated by reference.

TECHNICAL FIELD

This invention relates to polishing chucks, to semiconductor wafer polishing chucks, to abrading methods, to polishing methods, to semiconductor wafer polishing methods, and to methods of forming polishing chucks.

BACKGROUND OF THE INVENTION

Polishing systems can typically include a polishing chuck which holds a work piece, and a platen upon which a polishing pad is mounted. One or more of the chuck and platen can be rotated and brought into physical contact with the other, whereby the work piece or portions thereof are abraded, ground, or otherwise polished. One problem associated with abrading, grinding or polishing work pieces in such systems, concerns uniformly removing or controlling the amount of material being removed from over the surface of a work piece.

Specifically, because of the dynamics involved in abrading work pieces, greater amounts of material can be removed over certain portions of a work piece, while lesser amounts of material are removed over other portions. Such can result in an undesirable abraded, ground, or polished profile. Yet, in other applications, it can be desirable to remove, somewhat unevenly, material from over certain portions of a work piece and not, or to a lesser degree over other portions of a work piece.

One challenge which has confronted those who process wafers is associated with retaining a wafer or work piece (which need not necessarily be a wafer), on the chuck when abrading or polishing the same. Because of the rotational velocities involved with such processing, the wafer can tend to slip off of the chuck during processing. One solution in the past has been to maintain vacuum pressure on the wafer during most or all of the processing of concern. That is, vacuum ports provided in the chuck to effect vacuum engagement of a wafer are essentially operated to maintain a vacuum relative to the wafer during abrading or polishing. However, such can cause dimpling of the wafer at these port locations which, in turn, can cause incomplete polishing of the wafer.

This invention arose out of concerns associated with providing improved uniformity in abrading, grinding, and/or polishing scenarios. In particular, this invention arose out of concerns associated with providing uniformity and flexibility in the context of semiconductor wafer processing, wherein such processing includes abrading, grinding, or otherwise polishing a semiconductor wafer or work piece.

SUMMARY OF THE INVENTION

Polishing chucks, semiconductor wafer polishing chucks, abrading methods, polishing methods, semiconductor wafer polishing methods, and methods of forming polishing chucks are described. In one embodiment, a polishing chuck includes a body dimensioned to hold a work piece, and a multi-positionable, force-bearing surface is positioned on the body. The surface has an undeflected position, and is bi-directionally deflectable away from the undeflected position. A deformable work piece-engaging member is disposed adjacent the force-bearing surface for receiving a work piece thereagainst. The work piece-engaging member is positioned for movement with the force-bearing surface. In another embodiment, a yieldable surface is provided on the body and has a central area and a peripheral area outward of the central area. One of the central and peripheral areas is movable, relative to the other of the areas, to provide both inwardly and outwardly flexed surface configurations. A porous member is provided on the yieldable surface and is positioned to receive a work piece thereagainst. The porous member is preferably movable by the yieldable surface into the surface configurations. In yet another embodiment, a generally planar surface is provided on the body and positioned to receive the work piece thereagainst. The surface is movable into a non-planar, force-varying configuration in which more force can be exerted on outermost portions of a work piece during polishing than on innermost portions of a work piece. A deflector is operably connected with the surface and configured to move the surface into the non-planar configuration. A work piece-engaging expanse of material is positioned on the surface of the body and is movable thereby when the surface is moved into the non-planar, force-varying configuration.

BRIEF DESCRIPTION OF THE DRAWINGS

Preferred embodiments of the invention are described below with reference to the following accompanying drawings.

FIG. 4 is a view which is somewhat similar to the FIG. 2 view, but is one which shows certain aspects of the invention in more detail.

FIG. 6 is a view which is somewhat similar to the FIG. 5 view, but is one which shows a work piece mounted on a chuck in accordance with another embodiment of the invention.

FIG. 7 is a high level block diagram of an abrading system in accordance with one embodiment of the present invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
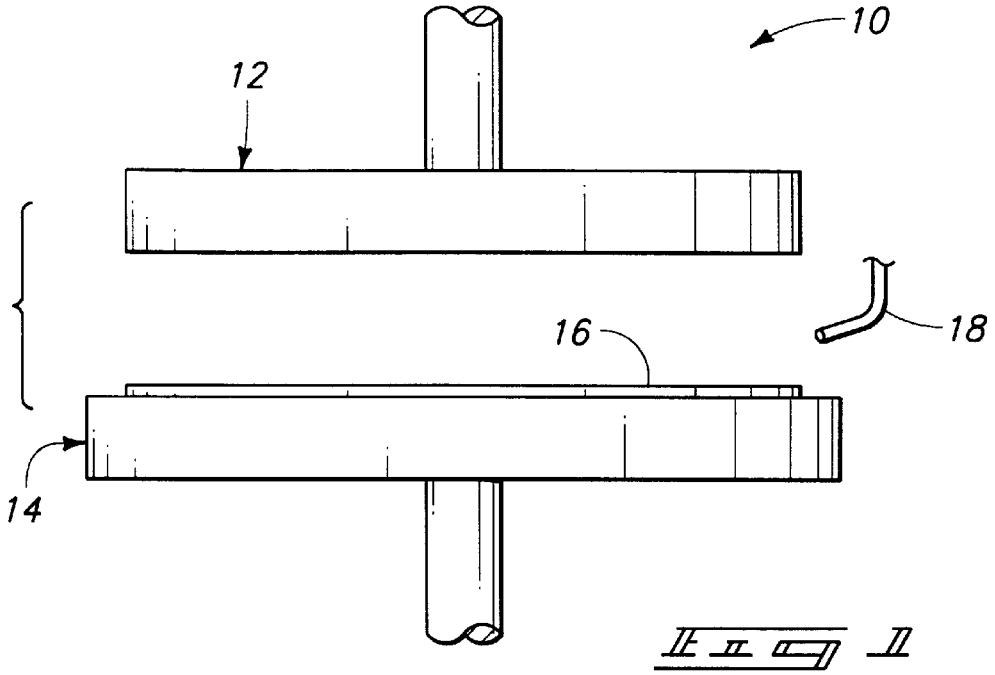
FIG. 1 is a side elevational view of one abrading system which sets forth some basic exemplary elemental features thereof.

Referring to FIG. 1, an abrading system is shown generally at 10 and includes a chuck 12, and a platen 14. A polishing pad 16 is provided and mounted on platen 14. A polishing media source 18 can a be provided for delivering a polishing fluid, e.g. polishing slurry, onto polishing pad 16. Abrading system 10 is typically operated by rotating either or both of chuck 12 and platen 14 to effectuate abrading, grinding, or otherwise polishing of a work piece which is retained or held by chuck 12. In a preferred embodiment, abrading system 10 is configured to process semiconductor wafers and, accordingly, is configured as a semiconductor wafer polishing system. Other types of material can, however, be polished utilizing abrading system 10. Such materials include sheets of metal or glass, ceramic discs, or any other type of material which can be polished in accordance with principles of the invention described just below. Particular types of materials with which the invented systems and methods find utility concern those materials which are flexible to some degree. Such will become more readily apparent as the description below is read.

Figure 3:
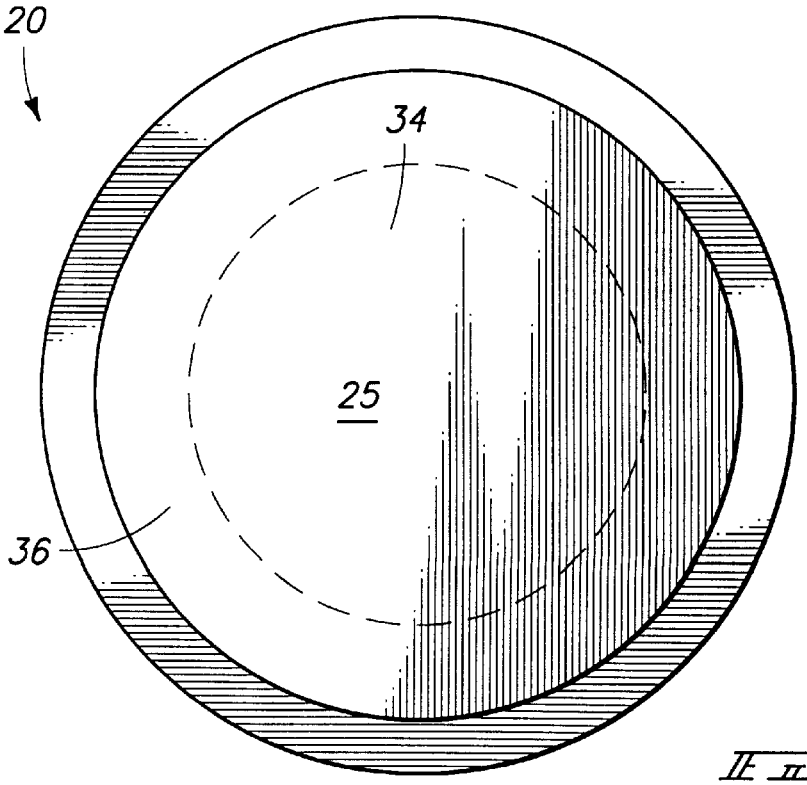
FIG. 3 is a view, from the bottom up, of an underside of a polishing chuck in accordance with one embodiment of the invention.
Figure 2:
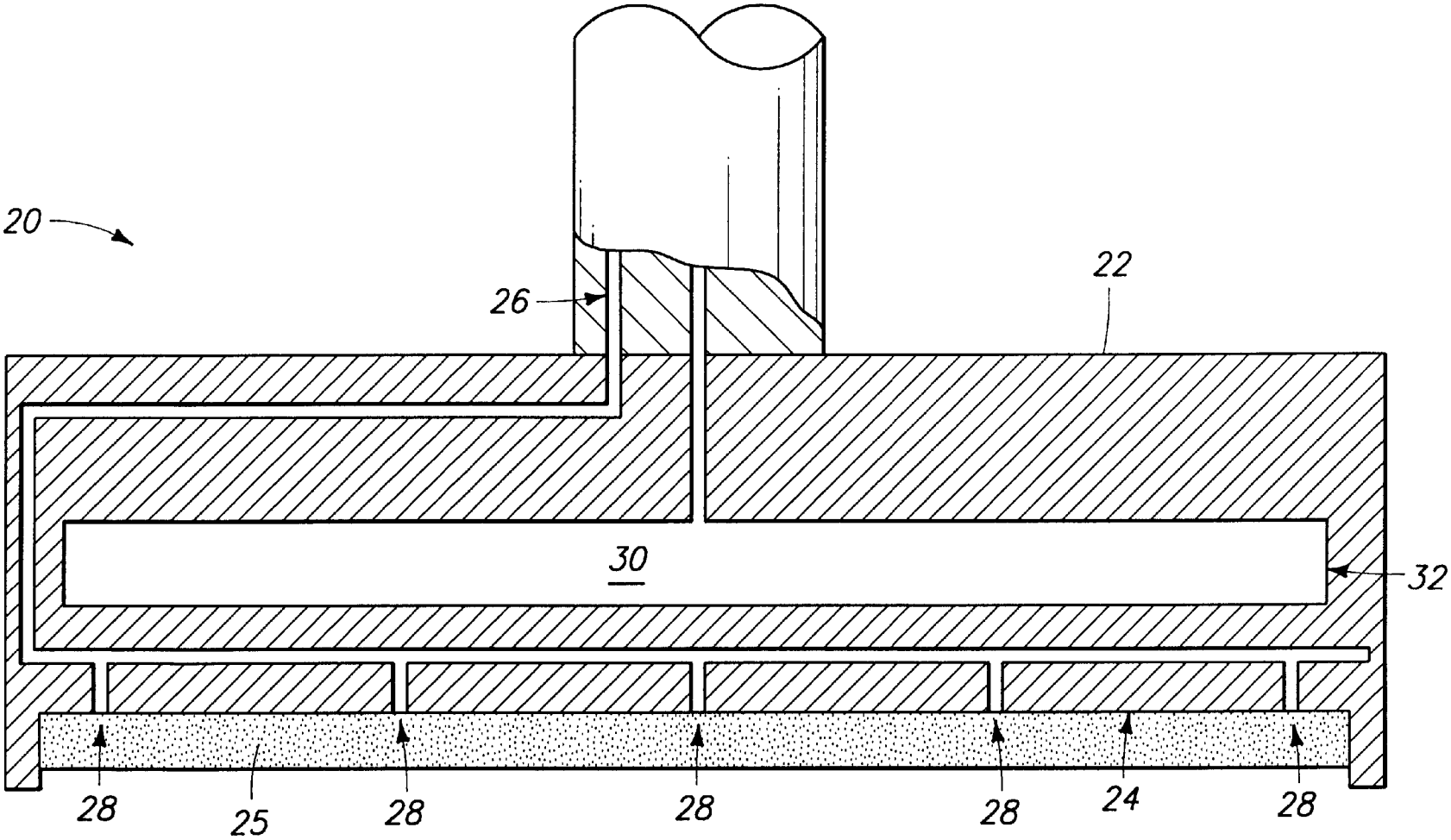
FIG. 2 is an enlarged sectional and fragmentary view of an abrading chuck in accordance with one embodiment of the invention.
Figure 3:
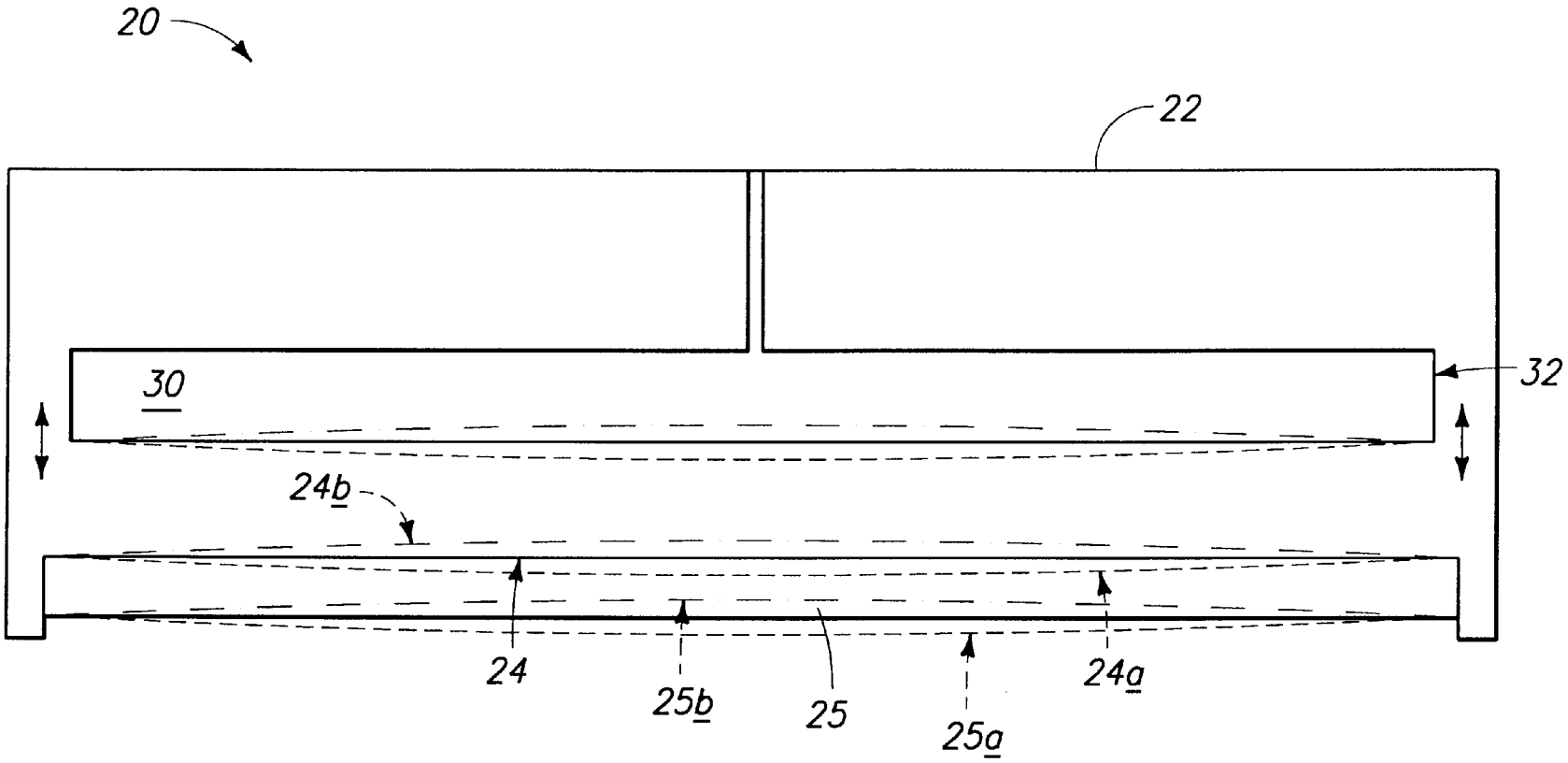

Referring to FIGS. 2–4, a chuck is shown generally at 20 and includes a body 22 which is dimensioned to hold a work piece which is to be abraded, ground, or otherwise polished. In a preferred embodiment, body 22 is dimensioned to receive and hold a generally planar semiconductor wafer, e.g. an eight-inch wafer. In one embodiment, chuck 20 is provided with a multi-positionable, force-bearing surface 24 which is positioned on body 22 for movement relative thereto. A deformable work piece-engaging member 25 is provided and disposed adjacent force-bearing surface 24 for receiving a work piece thereagainst. In one embodiment, work piece-engaging member 25 comprises a discrete member which is fixedly mounted on force-bearing surface 24. Optionally, it can be removably mounted on force-bearing surface 24. Mounting can take place through the use of any suitable means which is (are) suitable for use in the operating environment, e.g. epoxy, mechanical mounting, etc. Exemplary materials from which the work piece-engaging material can be formed include various ceramic, metal, or plastic materials to name just a few. Other materials can, of course, be used. Work piece engaging member 25 is positioned for movement with force-bearing surface 24 as will become apparent below. In one embodiment, work piece-engaging member 25 is generally porous. The porosity allows a more evenly-established vacuum to be established relative to a retained work piece. Exemplary and preferred thicknesses for member 25 can range from between about 0.125 to 0.5 of an inch. Other thicknesses can, of course be employed. In the illustrated example, a vacuum conduit 26 (FIG. 2) is provided and includes a plurality of outlets 28 which are used to retain a semiconductor wafer through negative vacuum pressure as will become apparent below.

In one multi-positionable embodiment, force-bearing surface 24 has an undeflected or neutral position (shown in solid lines in FIG. 4 at 24). When in the neutral position, in this example, the outer surface of work piece engaging member 25 is essentially generally planar, or otherwise generally follows the contour of surface 24. Force-bearing surface 24 is preferably bi-directionally deflectable away from the undeflected position to different positions, one of which being shown by dashed line 24*a*, the other of which being shown by dashed line 24*b*. When the force-bearing surface is placed into the illustrated deflected positions, so too is the outer surface of work piece-engaging member 25 as shown at 25*a*, 25*b* respectively.

In a preferred embodiment, deflection of force-bearing surface 24 takes place in a direction which is generally normally away from the force-bearing surface when in the undeflected position. For example, FIG. 4 shows force-bearing surface 24 in an undeflected (solid line) position. A deflected force-bearing surface is shown at 24*a* and has been deflected in a first direction which is generally normally away from force-bearing surface 24 in the undeflected position. The same can be said of the position depicted at 24*b*, only with movement taking place in the opposite direction. Deflection can take place through a range which is one micron or less away from the undeflected position.

Deflection of force-bearing surface 24 can be achieved, in but one example, in one or both of the directions, by providing a region 30 proximate force-bearing surface 24 which is expandable or contractible to displace the force-bearing surface in a particular direction. Region 30 is preferably selectively placeable into a variety of pressure configurations which act upon and thereby displace the force-bearing surface sufficiently to deflect the surface in one or more directions away from the undeflected position. In a preferred embodiment, a pressure chamber 32 is provided proximate force-bearing surface 24 and is configured to develop regions of positive and/or negative pressure sufficient to deflect surface 24. Movement of force-bearing surface 24 also moves work piece-engaging member 25 along with it as shown in FIG. 4. Pressure can be controlled through the use of gases or fluids, and can be mechanically or electronically regulated.

Figure 5:
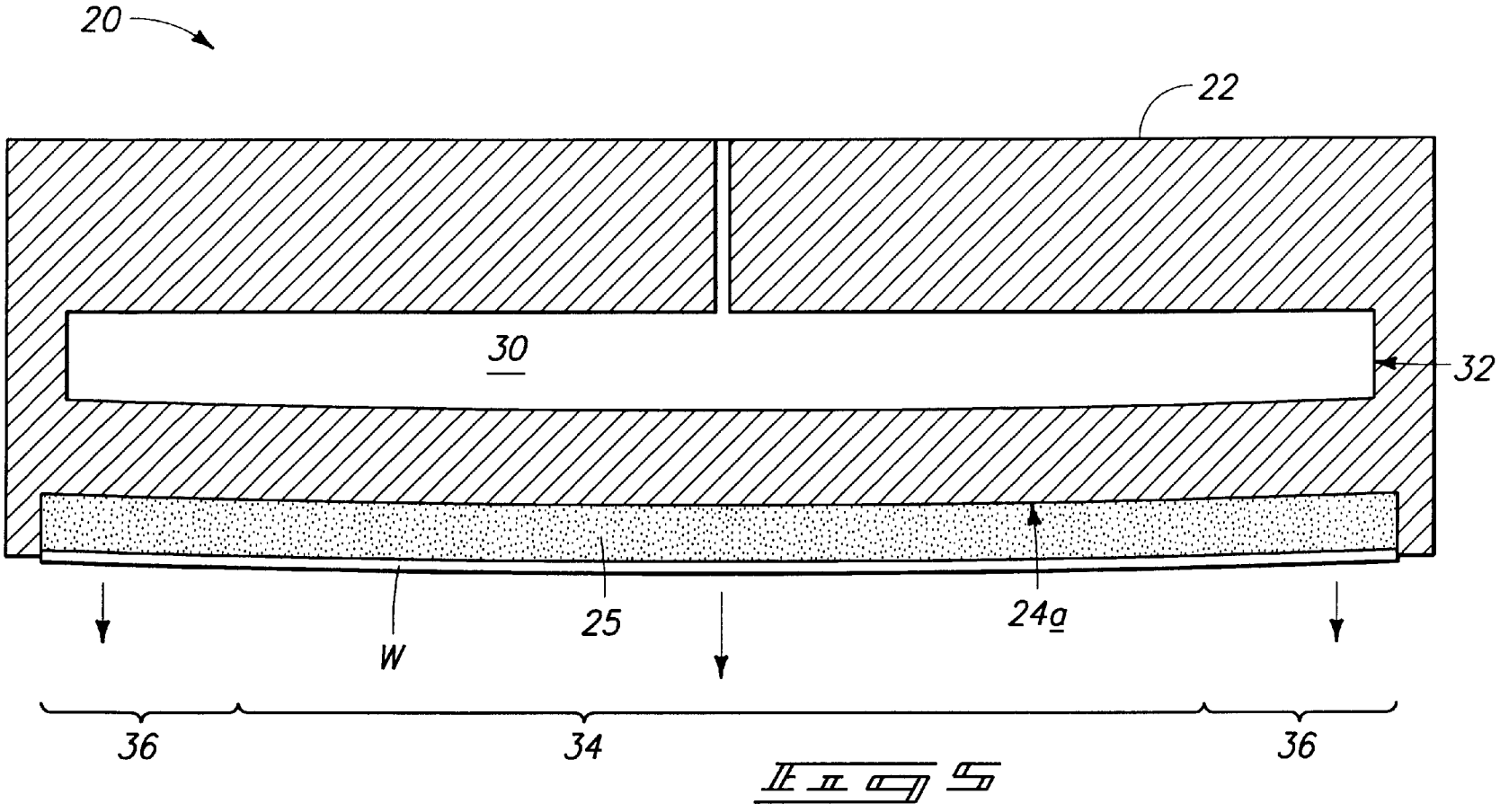
FIG. 5 is a view which is somewhat similar to the FIG. 4 view, but is one which shows a work piece mounted upon a chuck, in accordance with one embodiment of the invention.
Figure 11:
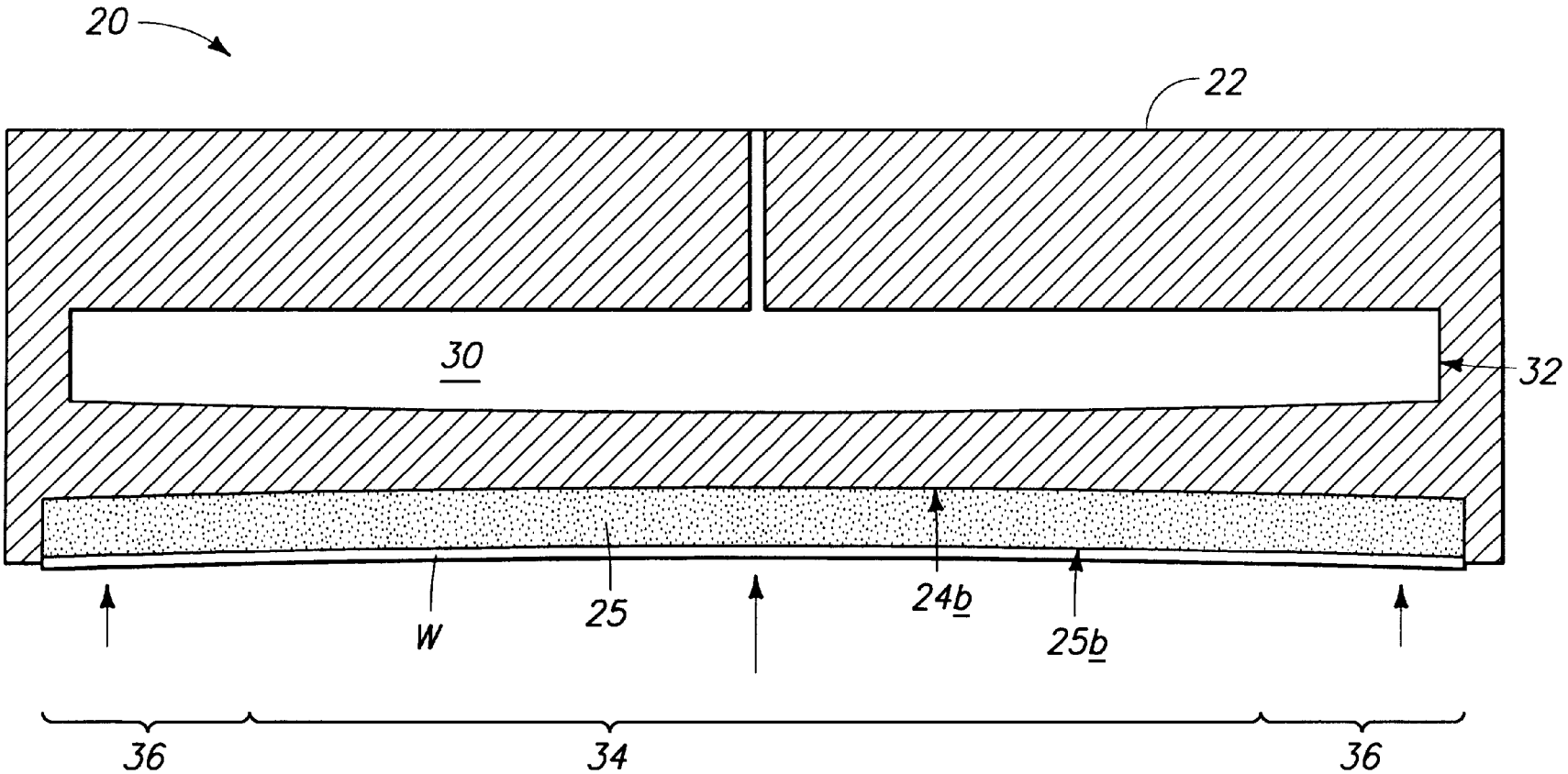
Figure 11:
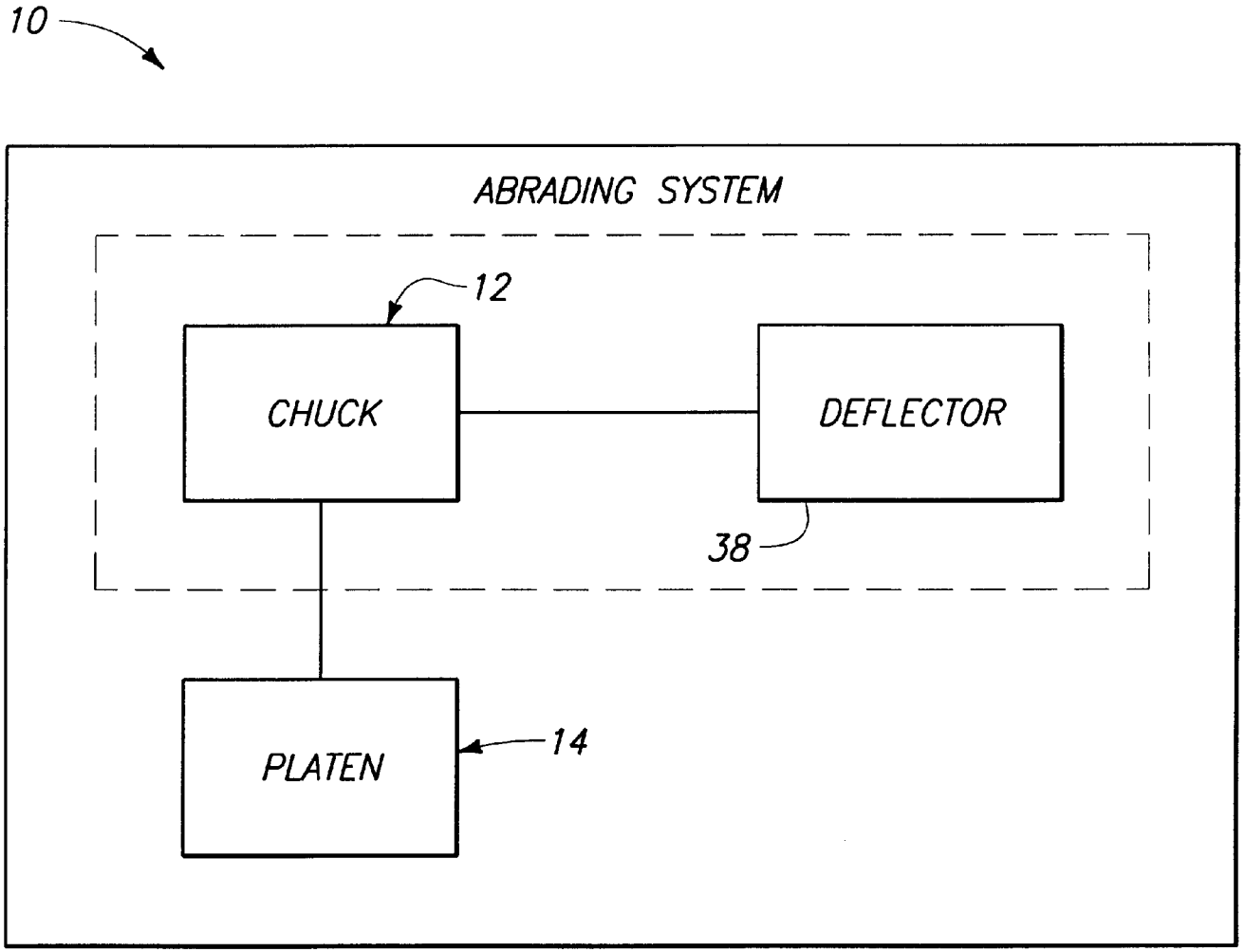

In another embodiment, a yieldable surface 24 is provided on body 22 and includes a central area 34 (FIG. 3) and a peripheral area 36 outward of central area 34. One of the central and peripheral areas 34, 36 is movable relative to the other of the areas to provide both outwardly and inwardly flexed surface configurations as shown in FIGS. 4–6. A porous member 25 is provided on yieldable surface 24 and is positioned to receive a work piece thereagainst. Preferably, porous member 25 is movable with yieldable surface 24 into the described configurations. In the illustrated and preferred embodiment, central area 34 is movable relative to peripheral area 36 to achieve the various configurations. A pressure-variable region, such as region 30, can be provided proximate the one movable area, e.g. either or both of areas 34 or 36, and configured to develop desired pressures which are sufficient to move the area(s) into the inwardly and outwardly flexed surface configurations. In the illustrated example, the pressure-variable region is provided proximate both central and peripheral areas 34, 36.

Alternately considered, surface 24 constitutes, in one embodiment, a generally planar surface on body 22 which is movable into a non-planar, force-varying configuration in which more force can be exerted on outermost portions of a work piece during polishing than on innermost portions of a work piece. An exemplary non-planar, force-varying configuration is shown in FIG. 6 where surface 24*b* is seen to bow inwardly slightly away from the center of wafer W. In this example, the non-planar, force-varying configuration is generally concave toward the work piece.

A work piece-engaging expanse of material 25 is provided and positioned on the surface of body 22. Preferably, work piece-engaging expanse 25 is movable by surface 24 of the body when the surface is moved into the non-planar, force-varying configuration. Typically with work pieces which are flexible, as semiconductor wafers are, the wafer will tend to follow the contour of the surface of expanse 25. In one embodiment, expanse 25 comprises a resilient material. Such resilient materials can, in some instances, when acted upon by vacuum outlets 28 FIG. 3, have portions which are drawn up partially into the outlets thereby forming individual discrete vacuum pockets which each, individually engage and thereby retain a portion of the work piece being held. In another embodiment, expanse 25 comprises a porous material. Such materials can more evenly spread out an applied vacuum over the surface of a work piece, thereby minimizing or avoiding all together the problems associated with dimpling the frontside of a work piece during polishing. In another embodiment, expanse 25 comprises a resilient porous material.

In one embodiment, a deflector, such as deflector 38 (FIG. 7) is provided and is operably connected with surface 24 and configured to move the surface into the non-planar configuration. In one preferred embodiment, deflector 38 comprises a negative pressure assembly comprising a chamber, such as chamber 32, proximate surface 24 which is configured to develop negative pressures sufficient to move surface 24 into the non-planar, force-varying configuration which, in this example is generally outwardly concave.

In another preferred embodiment, deflector 38 comprises a pressure assembly comprising a chamber, such as chamber 32, proximate surface 24 which is configured to develop both negative and positive pressures which are sufficient to move surface 24 into different non-planar, force-varying configurations. In this example, the surface is movable into a second non-planar, force-varying configuration in which less force is exerted on outermost portions of the work piece by porous member 25 during polishing than on innermost portions of the work piece. Of course, with flexible wafers, the wafer would, as above, tend to follow the contour of the porous member.

In another preferred embodiment, surface 24 is movable into a plurality of configurations away from the generally planar configuration shown in solid lines in FIG. 4. These configurations can include incremental, non-planar configurations which are intermediate the generally planar (solid line) configuration shown at 24 in FIG. 4, and either or both of the non-planar configurations shown in dashed lines 24*a*, 24*b*, respectively. Accordingly, such incremental configurations can enable the force which is exerted on the outermost portions of the work piece by member 25 during polishing to be incrementally varied in accordance with the plurality of surface configurations into which the surface can be moved during polishing. In a preferred embodiment, the different non-planar, force-varying configurations can be assumed during polishing of the work piece and subsequently varied if so desired. Such provides an added degree of flexibility during the polishing of a wafer.

Alternately considered, at least a portion of surface 24 is movable in a direction away from wafer W (FIG. 6), wherein more force can be exerted by member 25 on selected wafer portions, e.g. outermost wafer portions, during polishing than on other wafer portions. At least a portion of surface 24 can also be movable in a direction toward wafer W (FIG. 5), wherein more force can be exerted by member 25 on selected wafer portions, e.g. innermost wafer portions, than other wafer portions. Surface 24 can also be movable into a plurality of positions wherein the exerted force can be varied. Such positions can occur incrementally between the neutral or undeflected position and either or both of the deflected positions, e.g. either toward or away from the wafer. One exemplary configuration is concave toward the wafer, and another exemplary configuration is concave away from the wafer.

In yet another embodiment, a semiconductor wafer polishing chuck includes a surface 24 on body 22 at least a portion of which is deflectable, and in a preferred embodiment, a force-varying deflector 38 is provided on body 22 and is operable to move the deflectable surface portion into both concave and convex force-varying configurations. A porous member 25 is provided on surface 24 and is movable therewith for directly engaging a semiconductor wafer. In one embodiment, the force-varying deflector comprises a region, such as region 30, proximate the surface portion which is selectively placeable into a variety of pressure configurations which act upon the surface portion sufficiently to move the surface portion into the concave and convex configurations. In one preferred embodiment, the force-varying deflector is operable to place the surface portion into a plurality of intermediate configurations between the concave and convex configurations. Other deflectors can be used such as mechanical actuators, pneumatically driven assemblies, piston assemblies, and the like.

Further considered, a semiconductor wafer polishing method includes mounting a semiconductor wafer on a wafer chuck having a porous wafer engaging surface. Polishing is initiated with a polishing surface and after the initiating and while polishing, the polishing force is changed between the wafer surface and the polishing surface and different polishing forces are provided for different radial locations of the wafer. In a preferred embodiment, the porous wafer-engaging surface comprises a porous member mounted on an underlying generally planar surface of the chuck.

In use, the various inventive abrading, grinding, and/or polishing systems provide for flexibility and/or uniformity before and during treatment of a work piece.

In one embodiment, a semiconductor wafer abrading method includes configuring a wafer abrading chuck, such as chuck 20, with a yieldable surface. A porous member 25 is provided on the yieldable surface for engaging a semiconductor wafer during abrading. The yieldable surface is deflectable into a generally concave configuration toward the wafer (FIG. 6) which exerts more force on a periphery of the wafer during polishing than on a center of the wafer. In a preferred embodiment, the deflecting of the yieldable surface can take place before and during polishing of the wafer, with the porous member being moved by the yieldable surface during deflection thereof.

In another embodiment, a polishing method includes providing a chuck having a body 22 dimensioned to hold a work piece which is to be polished. The polishing chuck includes a multi-positionable, force-bearing surface 24 positioned on the body. Surface 24 preferably has an undeflected position, and is bi-directionally deflectable away from the undeflected position. A deformable work piece-engaging member 25 is disposed adjacent force-bearing surface 24 for receiving a work piece thereagainst. The work piece-engaging member is positioned for movement with force-bearing surface 24. A work piece is subsequently caused to be engaged by member 25 via the multi-positionable; forces-bearing surface 24. In one embodiment, surface 24 is deflected in a direction away from the work piece (FIG. 6) thereby causing outer portions of the work piece to be engaged with more force than inner a portions of the work piece. In another embodiment, surface 24 is deflected in a direction away from the work piece during polishing thereof.

In other embodiments, methods of forming polishing chucks are provided. In one embodiment, a body, such as body 22, is provided and is dimensioned to hold a work piece which is to be polished. A multi-positionable, force-bearing surface, such as surface 24, is mounted on the body and preferably has an undeflected position and is bi-directionally deflectable away from the undeflected position as described above. A porous member 25 is provided on force-bearing surface 24 and is positioned to engage a work piece which is held by body 22. In one embodiment, a work piece is retained on body 22 by using porous member 25 to develop a work piece-retaining force relative to the work piece. In a preferred embodiment, the work piece-retaining force comprises a vacuum pressure as described above.

Various of the above-described embodiments can improve upon previous known methods and apparatus for effecting abrading and/or polishing of work pieces. Dimpling of the work piece frontsides can be reduced, if not eliminated thereby adding more predictability to the abrading or polishing process which, in turn, can increase yields. In addition, risks associated with a work piece becoming dislodged during processing can be reduced. Moreover, the ability to variably load a work piece during processing and thereby desirably variably polish or abrade the work piece can be enhanced.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A wafer polishing method comprising:

mounting a semiconductor wafer on a wafer chuck having a flexible porous wafer-engaging surface;

initiating polishing of a surface of the semiconductor wafer with a polishing surface; and after the initiating and while polishing, changing a polishing force between the surface of the semiconductor wafer and the polishing surface and providing different polishing forces for different radial locations of the surface of the semiconductor wafer.

2. The semiconductor wafer polishing method of claim 1, wherein mounting a semiconductor wafer on a wafer chuck comprises mounting the semiconductor wafer on a flexible porous member mounted on an underlying generally planar surface of the chuck.

3. The semiconductor wafer polishing method of claim 1, wherein mounting a semiconductor wafer comprises mounting the semiconductor wafer on the wafer chuck wherein the wafer chuck is configured to include a conduit configured to couple a vacuum between the wafer chuck and the semiconductor wafer.

4. A wafer polishing method comprising:

mounting a semiconductor wafer on a multipositionable, force bearing surface coupled to a body dimensioned to hold the semiconductor wafer to be polished, the force-bearing surface having an undeflected position and being bidirectionally deflectable away from the undeflected position, the body including a deformable, porous work-piece engaging member disposed adjacent the force-bearing surface and configured to receive the semiconductor wafer thereagainst, the semiconductor piece-engaging member being configured for movement with the force-bearing surface;

initiating polishing of a surface of the semiconductor wafer with a polishing surface; and after the initiating and while polishing, changing a polishing force between the surface of the semiconductor wafer and the polishing surface and providing different polishing forces for different radial locations of the surface of the semiconductor wafer.

5. The wafer polishing method of claim 4, wherein mounting a semiconductor wafer comprises mounting the semiconductor wafer on the deformable, porous work-piece engaging member wherein the member is configured to be fixedly mounted on the force-bearing surface.

6. The wafer polishing method of claim 4, wherein mounting a semiconductor wafer comprises mounting the semiconductor wafer on the multipositionable, force-bearing surface wherein the surface is configured to be deflectable in a direction generally normally away from the force-bearing surface in the undeflected position.

7. The wafer polishing method of claim 4, further comprising selectively placing a region proximate the force-bearing surface, the region being configured to adapt into a variety of pressure configurations configured to act upon the force-bearing surface sufficiently to deflect the force-bearing surface in one direction away from the undeflected position.

8. The wafer polishing method of claim 4, wherein mounting a semiconductor wafer comprises mounting the semiconductor wafer on the multipositionable, force bearing surface coupled to the body wherein the body is configured to include a pressure chamber proximate the force-bearing surface and configured to develop regions of positive and negative pressure sufficient to deflect the force-bearing surface.

9. The wafer polishing method of claim 4, wherein mounting a semiconductor wafer comprises mounting the semiconductor wafer on the multipositionable, force bearing surface coupled to the body wherein the body is dimensioned to hold a generally flat work piece.

10. The wafer polishing method of claim 4, further comprising positioning a pad in proximity with the force-bearing surface for abrading the surface of the semiconductor wafer.

11. The wafer polishing method of claim 4, wherein mounting a semiconductor wafer comprises mounting the semiconductor wafer on the multipositionable, force bearing surface coupled to the body wherein the body is configured to include a conduit configured to couple a vacuum between the body and the semiconductor wafer.

12. A wafer polishing method comprising:

mounting a wafer to be polished on a body dimensioned to hold the wafer and including a yieldable surface on the body having a central area and a peripheral area outward of the central area, one of the central and peripheral areas being movable relative to the other of the central and peripheral areas to provide either inwardly or outwardly flexed surface configurations, the body including a deformable, porous member on the yieldable surface positioned to receive the wafer thereagainst and that is movable by the yieldable surface into the surface configurations;

initiating polishing of a surface of the wafer with a polishing surface; and after the initiating and while polishing, changing a polishing force between the surface of the wafer and the polishing surface and providing different polishing forces for different radial locations of the surface of the wafer.

13. The wafer polishing method of claim 12, wherein mounting a wafer comprises mounting the wafer on the body wherein the central area of the yieldable surface is configured to be movable relative to the peripheral area.

14. The wafer polishing method of claim 12, wherein mounting a wafer comprises mounting the wafer on the body wherein the body is configured to provide a pressure-variable region proximate the one movable area and configured to develop pressures sufficient to move the one area into the inwardly and outwardly flexed surface configurations.

15. The method of claim 12, wherein mounting a wafer comprises mounting the wafer on the body wherein the central area of the yieldable surface is configured to be movable relative to the peripheral area, and the body further includes a pressure-variable region proximate the central area and configured to develop pressures sufficient to move the central area into the inwardly and outwardly flexed surface configurations.

16. The method of claim 12, wherein mounting a wafer comprises mounting the wafer on the body wherein the body is configured to provide a pressure-variable region proximate the central and peripheral areas and configured to develop pressures sufficient to move the yieldable surface into the inwardly and outwardly flexed surface configurations.

17. The method of claim 12, wherein mounting a wafer comprises mounting the wafer on the body wherein the central area of the yieldable surface is configured to be movable relative to the peripheral area, and the body is configured to include a pressure-variable region proximate the central and peripheral areas and configured to develop pressures sufficient to move the yieldable surface into the inwardly and outwardly flexed surface configurations.

18. The method of claim 12, further comprising including a pad positioned in proximity with the yieldable surface for abrading the surface of the wafer.

19. The method of claim 12, wherein mounting a wafer comprises mounting the wafer on the body wherein the body is configured to include a is conduit configured to couple a vacuum between the body and the wafer.

20. A polishing method comprising:

mounting a work piece to be polished on a body dimensioned to hold the work piece and including a generally planar surface on the body that is movable into one of a plurality of non-planar, force-varying configurations each allowing more force to be exerted on outermost portions of a work piece during polishing than on innermost portions of the work piece, the body including a deflector operably coupled with the surface and configured to move the surface into the non-planar configuration and wherein the body includes a deformable, porous work piece-engaging expanse of material coupled to the surface of the body and movable thereby when the surface is moved into one of the plurality of non-planar, force-varying configurations;

initiating polishing of a surface of the work piece with a polishing surface; and after the initiating and while polishing, changing a polishing force between the work piece surface and the polishing surface and providing different polishing forces for different radial locations of the surface of the work piece.

21. The method of claim 20, wherein mounting a work piece comprises mounting the work piece on the generally planar surface on the body wherein the plurality of non-planar, force-varying configurations comprise configurations generally concave toward the work piece.

22. The method of claim 20, wherein mounting a work piece comprises mounting the work piece on the body wherein the body is configured to include a deflector comprising a negative pressure assembly including a chamber proximate the body surface and configured to develop negative pressures sufficient to move the surface into the plurality of non-planar, force-varying configurations.

23. The method of claim 20, wherein mounting a work piece comprises mounting the work piece on the body wherein the body is configured to include a pressure assembly including a chamber proximate the body surface and configured to develop either negative or positive pressures sufficient to move the surface into different non-planar, force-varying configurations.

24. The method of claim 20, wherein mounting a work piece comprises mounting the work piece on the body wherein the plurality of non-planar, force-varying configurations comprise generally outwardly concave configurations, the body being configured to include a negative pressure assembly coupled to the deflector including a chamber proximate the body surface and configured to develop negative pressures sufficient to move the surface into different ones of the plurality of non-planar, force-varying configurations.

25. The method of claim 20, wherein mounting a work piece comprises mounting the work piece on the body wherein generally planar work surface is configured to be movable into a plurality of configurations away from the generally planar configuration, and wherein the polishing force exerted on the outermost portions of the work piece during polishing is configured to be variable in response to the surface moving into one of the plurality of non-planar, force-varying configurations.

26. The method of claim 20, wherein mounting a work piece comprises mounting the work piece on the body wherein generally planar work surface is configured to be movable into a second non-planar, force-varying configuration exerting less polishing force on outermost portions of the work piece during polishing than on innermost portions of the work piece.

27. The method of claim 20, wherein mounting a work piece comprises mounting the work piece on the body wherein the generally planar work surface is configured to be movable into a second non-planar, force-varying configuration exerting less polishing force on outermost portions of the work piece during polishing than on innermost portions of the work piece, and wherein the surface is configured to be movable into a plurality of configurations away from the generally planar configuration and toward the non-planar, force-varying configurations such that the polishing force exerted on the outermost portions of the work piece during polishing is variable in response to the surface moving into one of the plurality of non-planar, force-varying configurations.

28. The method of claim 20, wherein mounting a work piece comprises mounting the work piece on the body wherein the surface is configured to be movable into a second non-planar, force-varying configuration in which less polishing force is exerted on outermost portions of the work piece during polishing than on innermost portions of the work piece, wherein the surface is configured to be movable into a plurality of configurations away from the generally planar configuration and toward the non-planar, force-varying configurations such that the polishing force exerted on the outermost portions of the work piece during polishing is variable in response to the surface being moved into one of the non-planar, force-varying configurations and wherein the deflector comprises a pressure assembly including a chamber proximate the body surface and configured to develop either negative or positive pressures sufficient to move the surface into different non-planar, force-varying configurations.

29. The method of claim 20, wherein mounting a work piece comprises mounting the work piece on a resilient material coupled to the surface of the body.

30. The method of claim 20, wherein mounting a work piece comprises mounting the work piece on the body wherein the body is configured to include a conduit configured to couple a vacuum between the work piece and the body.

31. A method comprising:

mounting a semiconductor wafer to be polished on a body dimensioned to receive a generally planar semiconductor wafer, the body being configured to include a surface on the body at least a portion of which is configured to be movable in a direction away from the semiconductor wafer, the surface being configured to exert more force on outermost portions of a surface of the semiconductor wafer during polishing than on innermost portions of the surface of the semiconductor wafer, the body being configured to include a deformable, porous member positioned on the surface to engage the semiconductor wafer, the deformable, porous member being configured to be movable with the surface;

initiating polishing of the semiconductor wafer surface with a polishing surface; and after the initiating and while polishing, changing the polishing force between the semiconductor wafer surface and the polishing surface and providing different polishing forces for different radial locations of the semiconductor wafer surface.

32. The method of claim 31, wherein mounting a semiconductor wafer comprises mounting the semiconductor wafer on the body wherein at least some of the surface portion is configured to be movable in a direction toward the semiconductor wafer, the surface portion being configured to permit more polishing force to be exerted by the surface on the innermost portions than on the outermost portions.

33. The method of claim 31, wherein mounting a semiconductor wafer comprises mounting the semiconductor wafer on the body wherein the body is configured to include the surface on the body such that the surface portion is configured to be movable into a plurality of positions corresponding to different exerted forces.

34. The method of claim 31, wherein mounting a semiconductor wafer comprises mounting the semiconductor wafer on the body wherein the surface portion is configured to be movable in a direction toward the wafer and to permit more polishing force to be exerted by the surface on the innermost portions than on the outermost portions, the surface portion being configured to be movable into any of a plurality of positions toward and away from the semiconductor wafer to vary the exerted force.

35. The method of claim 31, wherein mounting a semiconductor wafer comprises mounting the semiconductor wafer on the body wherein the surface on the body is configured such that the body surface is movable into a configuration that is concave toward the semiconductor wafer.

36. The method of claim 31, wherein mounting a semiconductor wafer comprises mounting the semiconductor wafer on the body wherein the surface on the body is configured such to allow the surface portion to be movable in a direction toward the wafer, to allow more force to be exerted by the surface on the innermost portions than on the outermost portions and wherein the body surface is configured to be movable into configurations that are concave toward and away from the semiconductor wafer.

37. The method of claim 31, wherein mounting a semiconductor wafer comprises mounting the semiconductor wafer on the body wherein the body is configured to include a pressure chamber proximate the body surface and configured to develop a plurality of pressures sufficient to effect movement of the surface portion.

38. The method of claim 31, wherein mounting a semiconductor wafer comprises mounting the semiconductor wafer on the body wherein the surface on the body is configured to allow the surface portion to be movable in a direction toward the wafer to permit more polishing force to be exerted by the surface on the innermost portions than on the outermost portions, the body being configured to provide a pressure chamber proximate the body surface and configured to develop a plurality of pressures sufficient to effect movement of the surface portion.

39. The method of claim 31, wherein mounting a semiconductor wafer to be polished on a body comprises mounting the semiconductor wafer on the body wherein the body is configured to include a conduit configured to couple a vacuum between the semiconductor wafer and the body.

40. A method comprising:

mounting a semiconductor wafer to be polished on a body dimensioned to receive the semiconductor wafer, the body being configured to include a surface on the body at least a portion of which is configured to be deflectable, the body being configured to include a force-varying deflector on the body operably connected with the surface, the force-varying deflector being configured to move the deflectable surface portion into either concave or convex configurations, wherein a polishing force with which the semiconductor wafer is engaged by the surface is varied, the body being configured to include a deformable, porous member on the surface of the body and movable therewith for directly engaging the semiconductor wafer;

initiating polishing of a surface of the semiconductor wafer surface with a polishing surface; and after the initiating and while polishing, changing the polishing force between the semiconductor wafer surface and the polishing surface and providing different polishing forces for different radial locations of the semiconductor wafer surface.

41. The method of claim 40, wherein mounting a semiconductor wafer comprises mounting the semiconductor wafer on the body wherein the force-varying deflector is configured to comprise a region proximate the surface portion configured to be selectively placeable into a variety of pressure configurations configured to act upon the surface portion sufficiently to move the surface portion into the concave and convex configurations.

42. The method of claim 40, wherein mounting a semiconductor wafer comprises mounting the semiconductor wafer on the body wherein the force-varying deflector is configured such that the force-varying deflector includes a region proximate the surface portion configured to be selectively placeable into a variety of pressure configurations configured to act upon the surface portion sufficiently to move the surface portion into the concave and convex configurations, and into any of a plurality of intermediate configurations between the concave and convex configurations.

43. The method of claim 40, wherein mounting a semiconductor wafer comprises mounting the semiconductor wafer on the body wherein the body is configured to include a conduit configured to couple a vacuum between the semiconductor wafer and the body.

44. A semiconductor wafer abrading method comprising:

mounting a semiconductor wafer on a wafer abrading chuck configured with a yieldable surface positioned to cause the semiconductor wafer to be variably loaded during abrading, the body being configured to include a deformable, porous member on the yieldable surface for engaging the semiconductor wafer during abrading; and deflecting the yieldable surface into a generally concave configuration toward the wafer that exerts more force on a periphery of the semiconductor wafer during abrading than on a center of the semiconductor wafer, the deformable, porous member being moved by the yieldable surface during the deflecting.

45. The semiconductor wafer abrading method of claim 44, wherein the deflecting of the yieldable surface comprises deflecting the surface during abrading of the wafer.

46. The semiconductor wafer abrading method of claim 44, wherein mounting a semiconductor wafer comprises mounting the semiconductor wafer on the wafer abrading chuck wherein the wafer abrading chuck is configured to include a conduit configured to couple a vacuum between the semiconductor wafer and the wafer abrading chuck.

47. A polishing method comprising:

mounting a work piece to be polished on a polishing chuck including a body dimensioned to hold the work piece, the body being configured to include a multi-positionable, force-bearing surface positioned on the body, the surface having an undeflected position and being bi-directionally deflectable away from the undeflected position, the body being configured to include a deformable, porous work piece-engaging member disposed adjacent the force-bearing surface for receiving the work piece thereagainst, the work piece-engaging member being positioned for movement with the force-bearing surface; and engaging the work piece with the work piece-engaging member and deforming the work piece-engaging member with the force-bearing surface.

48. The polishing method of claim 47, wherein mounting a work piece comprises mounting the work piece on the polishing chuck wherein the deformable, porous work piece-engaging member is configured to deflect the surface in a direction away from the work piece and to engage outer portions of the work piece with more polishing force than inner portions of the work piece.

49. The polishing method of claim 47, wherein mounting a work piece comprises mounting the work piece on the polishing chuck wherein the deformable, porous work piece-engaging member is configured to deflect the surface during polishing of the work piece.

50. The polishing method of claim 47, wherein mounting a work piece comprises mounting the work piece on the polishing chuck wherein the polishing chuck is configured to include a conduit configured to couple a vacuum between the work piece and the polishing chuck.

51. A method of polishing a work piece on a polishing chuck comprising:

mounting the work piece on a body dimensioned to hold the work piece, the body being configured to include a multi-positionable, force-bearing surface having an undeflected position and being bi-directionally deflectable away from the undeflected position, the body being configured to include a deformable, porous member on the force-bearing surface positioned to engage the work piece;

initiating polishing of a surface of the work piece with a polishing surface; and after the initiating and while polishing, changing a polishing force between the work piece surface and the polishing surface and providing different polishing forces for different radial locations of the work piece surface.

52. The method of claim 51, wherein mounting the work piece comprises mounting the work piece on the body wherein the body is configured to provide a region proximate the force-bearing surface, the region being configured to be selectively placeable into a variety of pressure configurations that act upon the force-bearing surface sufficiently to deflect the force-bearing surface in one direction away from the undeflected position.

53. The method of claim 51, wherein mounting the work piece comprises mounting the work piece on the body wherein the body is configured to provide a pressure chamber proximate the force-bearing surface and wherein the pressure chamber is configured to develop regions of positive and negative pressure sufficient to deflect the force-bearing surface.

54. The method of claim 51, further comprising retaining the work piece on the body by using the deformable, porous member to develop a work piece-retaining force relative to the work piece.

55. The method of claim 51 wherein mounting the work piece comprises mounting the work piece on the body wherein the body is configured to include a conduit configured to couple a vacuum between the work piece and the body.

* * * * *

UNITED STATES PATENT AND TRADEMARK OFFICE

CERTIFICATE OF CORRECTION

PATENT NO. : 6,277,000 B1
DATED : August 21, 2001
INVENTOR(S) : Leland F. Gotcher, Jr.

It is certified that error appears in the above-identified patent and that said Letters Patent is hereby corrected as shown below:

Title page, Item [54] and Column 1, Lines 1-6,
Title should read -- POLISHING CHUCKS, SEMICONDUCTOR WAFER POLISHING CHUCKS, ABRADING METHODS, POLISHING METHODS, SEMICONDUCTOR WAFER POLISHING METHODS AND METHODS OF FORMING POLISHING CHUCKS --.

Item [62], Related U.S. Application Data - delete "09/266,441" insert -- 09/266,411 --

ABSTRACT,
Line 16, delete "is".
Line 21, delete all text after the word configurations and insert a -- . --.

Column 6,
Lines 53 & 54, delete "forces-bearing" and insert -- force-bearing --.

Signed and Sealed this

Sixth Day of August, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,277,000 B1
DATED : August 21, 2001
INVENTOR(S) : Leland F. Gotcher, Jr.

It is certified that error appears in the above-identified patent and that said Letters Patent is hereby corrected as shown below:

Title page, Item [54] and Column 1, Lines 1-6,
Title should read -- POLISHING CHUCKS, SEMICONDUCTOR WAFER POLISHING CHUCKS, ABRADING METHODS, POLISHING METHODS, SEMICONDUCTOR WAFER POLISHING METHODS, AND METHODS OF FORMING POLISHING CHUCKS --.

Item [62], Related U.S. Application Data - delete "09/266,411" insert -- 09/266,441 --

ABSTRACT,
Line 16, delete "is".
Line 21, delete all text after the word configurations and insert a -- . --.

Column 1,
Line 9, RELATED PATENT DATA, delete "09.266,411" and insert -- 09/266,441 --.

Column 6,
Lines 53 & 54, delete "forces-bearing" and insert -- force-bearing --.

This certificate supersedes Certificate of Correction issued August 6, 2002.

Signed and Sealed this

Twelfth Day of November, 2002

*Attest:*

*Attesting Officer*

JAMES E. ROGAN
*Director of the United States Patent and Trademark Office*